US007802602B2

(12) United States Patent
Siedlaczek

(10) Patent No.: US 7,802,602 B2
(45) Date of Patent: Sep. 28, 2010

(54) LABELING DEVICE

(76) Inventor: Udo Siedlaczek, Hubertusstrasse 16, 47638 Strahlen (DE)

( * ) Notice: Subject to any disclaimer, the term of this patent is extended or adjusted under 35 U.S.C. 154(b) by 172 days.

(21) Appl. No.: 11/910,032

(22) PCT Filed: Mar. 30, 2006

(86) PCT No.: PCT/EP2006/002912

§ 371 (c)(1),
(2), (4) Date: Jul. 10, 2008

(87) PCT Pub. No.: WO2006/103077

PCT Pub. Date: Oct. 5, 2006

(65) Prior Publication Data

US 2009/0211712 A1 Aug. 27, 2009

(30) Foreign Application Priority Data

Mar. 30, 2005 (DE) ..... 10 2005 014 821

(51) Int. Cl.
*B65C 9/18* (2006.01)
*B65C 9/32* (2006.01)
*B65C 9/36* (2006.01)
*B65C 9/42* (2006.01)

(52) U.S. Cl. ..... 156/538; 156/542; 156/540; 156/541; 156/247; 156/566; 156/556

(58) Field of Classification Search ..... 156/540, 156/541, 542
See application file for complete search history.

(56) References Cited

U.S. PATENT DOCUMENTS 4,276,112 A 6/1981 French et al.

FOREIGN PATENT DOCUMENTS

DE 19920736 3/2000
EP 0506597 9/1992

OTHER PUBLICATIONS

International Search Report (including translation) for International (PCT) Patent Application No. PCT/EP2006/002912, mailed Aug. 9, 2006.
Written Opinion (including translation) for International (PCT) Patent Application No. PCT/EP2006/002912, mailed Aug. 9, 2006.
International Preliminary Report on Patentability (including translation) for International (PCT) Patent Application No. PCT/EP2006/002912, mailed Oct. 3, 2007.

*Primary Examiner*—Khanh Nguyen
*Assistant Examiner*—Margaret Squalls
(74) *Attorney, Agent, or Firm*—Jason H. Vick; Sheridan Ross, P.C.

(57) ABSTRACT

The invention concerns a labelling device (1) comprising a conveying device (3) provided with a drive unit (14) for transporting a supporting band (7) having a plurality of labels, and a dispensing device (2). The supporting band (7) comprising labels (6) is unwound on a label roll (9), then, once the labels are removed from the supporting band (7), the latter (7) is wound on a supporting band roll (10). The conveying device (3) has two roll units (8, 12) for the label roll (8) and the supporting band roll (10), said roll units capable of being driven each in different rotational directions. The transporting direction of the supporting band (7) may be reversed by inversion of the driving direction of the drive unit (14) for labelling containers (19) in two different labelling directions (X1, X2). The roll units (8, 12) are identically shaped.

12 Claims, 2 Drawing Sheets

LABELING DEVICE

Figure 1:
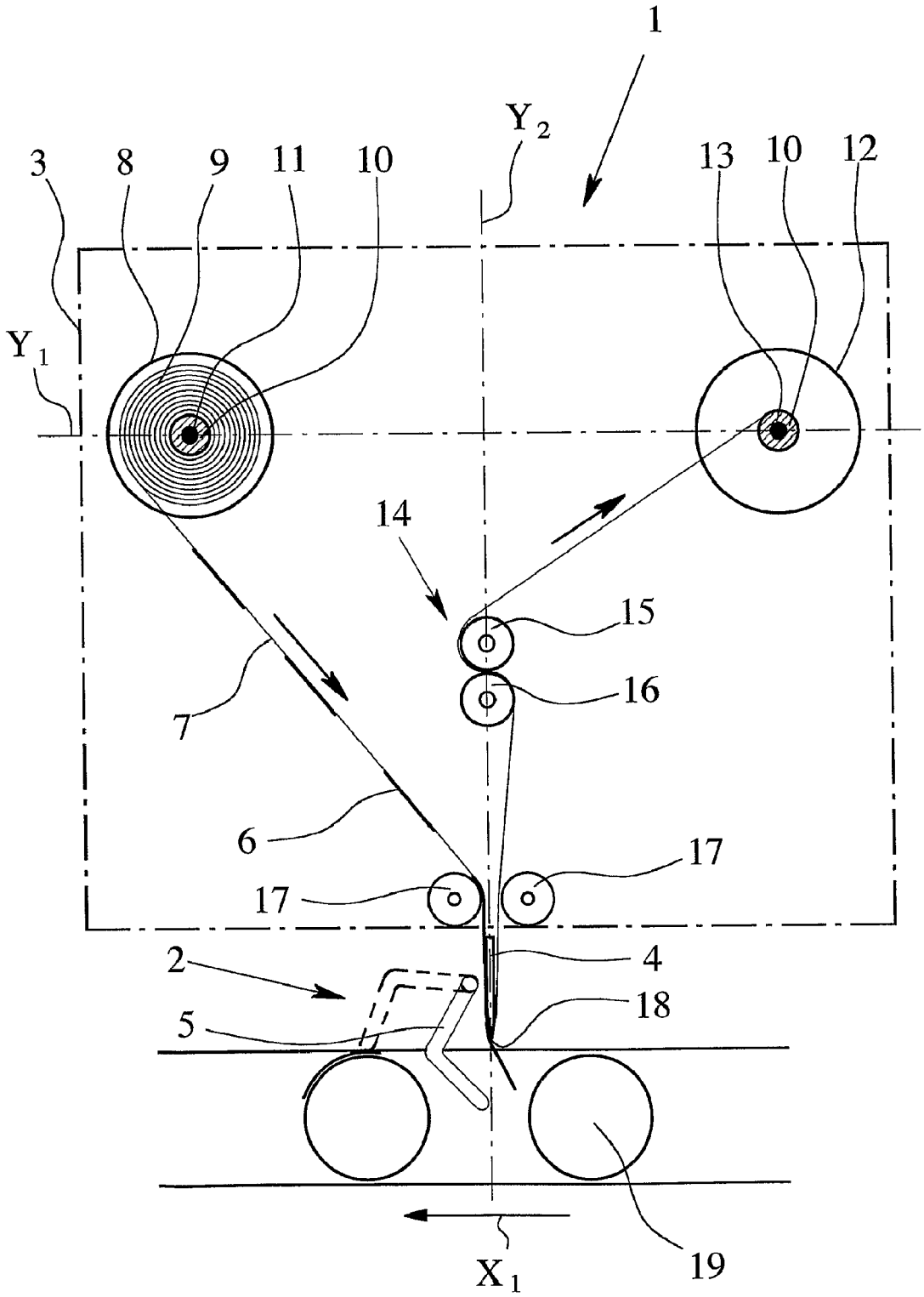

The invention relates to a labeling device with the features of the preamble of claim 1.

A labeling device is known from DE 199 20 736 A1 which makes labeling in two different labeling directions possible. However, in order to do this with the known device, it is necessary to undertake a plurality of modification and conversion measures in order to change the labeling direction. In each case, the modification comprises the conversion of a draw roller assembly and a push roller assembly, since the draw roller and the push roller are designed differently in the known device.

In order to dispense and reel up a backing tape for labels, the known device has a dispenser and a wind-up reel. In order to make a change in the labeling direction, it is necessary to convert the winding mandrel of the wind-up reel and the winding mandrel of the dispenser. The changing of the labeling direction is tedious in the known device due to the modification and conversion measures required.

It is the object of the present invention to make a labeling device of the type mentioned at the outset available with which it is possible to label objects in different labeling directions in a simple manner.

The aforementioned object is achieved according to the invention by means of a labeling device with the features of claim 1.

As a result of the invention, it is possible to carry out the labeling process in different labeling directions without a conversion of the conveying device being necessary with respect to the arrangement of the roller units and without the roller units having to be switched out. In connection with the invention, the term "modification" refers to the conversion of the labeling device, for example through the turning or shifting of components of the conveying device in connection with the change in the direction during the labeling process. In this respect, it is preferable that the changing of the labeling direction be possible completely without modification of the conveying device.

The labeling device according to the invention has two pivoted, identically designed roller units which can be provided as needed for the storage of the label roll during dispensing of the backing tape or for the storage of the backing tape during the reeling-up of the (empty) backing tape. It goes without saying that both roller units have appropriately designed mounting segments which enable the storage of both the label roll and the backing tape roll. Each roller unit can have a bearing pin which is disposed in the center of a storage plate. Moreover, it is self-evident that the roller unit is not limited to the design described above.

It is therefore possible to label in different labeling directions without the need for components that are specially designed for a certain labeling direction. Consequently, the changing of the labeling direction is facilitated and the flexible utilization of the labeling device according to the invention for labeling in different labeling directions is made possible. Moreover, the changing of the labeling direction is quicker than has been possible up to now, since the conveying device of the labeling device according to the invention does not have to be modified. The term "labeling direction" refers to the direction of conveyance of the container to be labeled immediately in front of the dispensing device.

The constructive design of the conveying device is not necessarily limited to a certain arrangement of the roller units relative to the drive unit and the dispensing device. The only essential thing is that it must be possible by virtue of the constructive design of the conveying device to dispense the backing tape from a label roll mounted on a roller unit and feed it to the dispensing device, with the backing tape being diverted at the dispensing device upon peeling-off of the labels. When the labeling direction is reversed, the direction of conveyance of the backing tape at the dispensing device is also reversed. The changing of the direction of diversion of the backing tape at the dispensing device has as a consequence that the labels are each detached from the backing tape with the adhesive side against the labeling direction of the objects to be labeled and adhere to the objects to be labeled being conveyed past the dispensing device. After the detachment of the labels, the label-free backing tape is conveyed to the other roller unit and reeled up there onto the backing tape roll. It is self-evident that a person skilled in the art can provide a plurality of guide rolls and other rolls as needed in order to ensure the conveyance of the backing tape on the conveyance path described above.

In order to convey the backing tape, the drive unit can have a drive roller and a counter-pressure roller, with the drive roller and the counter-pressure roller being arranged in an unchanged manner relative to the roller units. As a result, the backing tape can be conveyed in both labeling directions with an unchanged arrangement of the rolls from one roller unit over the dispensing device to the other roller unit. In this way, labeling in different labeling directions is further simplified, with preferably no modification or conversion of the conveying device being necessary at all upon changing the labeling direction. Moreover, the conveying device can have a plurality of drive rollers which are able to work together with the counter-pressure rollers and/or guide rollers. A control device can be provided to control the drive unit.

In order to ensure the reeling-up of the backing tape onto the backing tape roll in both labeling directions, both roller units can be kinematically coupled to the drive unit, with a rotation of the drive roller being converted into a rotation of at least the roller unit on which the backing tape roll is mounted. This contributes to a simple construction of the conveying device. In principle, it is of course also possible that independently controllable drives be provided in order to drive the roller units and the drive roller independently of each other.

In order to ensure that the tensile forces acting on the backing tape are essentially the same in both labeling directions, the roller units can be arranged next to each other on a first axis in one direction and the drive unit and the dispensing device under or over each other in another direction on a second axis, with the first axis and the second axis being overlaid in the manner of a cross, resulting in a mirror-symmetrical arrangement of the roller units relative to the drive unit and the dispensing device. This ensures that the tape load of the backing tape is always sufficiently low independently of the labeling direction, in order to rule out a damaging or tearing of the backing tape. In this connection, a provision can be made that the roller units and the dispensing device are arranged at the corner points of a substantially equal-sided triangle-shaped base surface of the conveying device, with the base of the triangle being determined by the position of the roller units and the tip of the triangle being determined by the position of the dispensing device. Both roller units can be spaced equally from the drive roller and from the counter-pressure roller of the drive unit. This ensures that equal tensile forces act on the backing tape during labeling in both labeling directions. This leads to a uniform loading of the backing tape independently of the direction of conveyance of the backing tape.

In order to prevent damage to the labels, a provision is preferably made that the drive unit is arranged subsequently in the direction of conveyance of the backing tape, i.e. behind the dispensing device. Furthermore, guide rollers or the like which are in themselves known from the prior art can be provided in order to tighten the backing tape along the path of conveyance and to ensure a continuous conveyance.

In order to peel the labels from the backing tape, the dispensing device can have a dispensing arm, with the longitudinal axis of the dispensing arm being disposed substantially perpendicular to the labeling direction in both labeling directions at least in the area of the tip. This makes it possible to carry out the labeling of the containers in one or the other labeling direction with the same arrangement of the labeling device relative to the containers being conveyed past the labeling device. In this case, the dispensing arm and the drive roller as well as the counter-pressure roller can be arranged under or over each other in one direction. This ensures the peeling of the labels from the backing tape during diversion at the dispensing device in both labeling directions without it being necessary to modify or convert the labeling device with respect to the containers being conveyed past the labeling device. In such a case, it is readily possible to have the dispensing arm joined in a fixed manner to the conveying device. It goes without saying that the arrangement of the dispensing arm can comprise a range of angles of preferably 80° to 100° essentially perpendicular to the labeling device, provided that the detachment of the labels from the backing tape is ensured in both of the directions of conveyance of the backing tape.

In order to make it possible to peel labels off the backing tape in both of the directions of conveyance of the backing tape or in both labeling directions of the containers to be labeled, a dispensing tongue can be provided at the free end of the dispensing arm, with the dispensing tongue having beveled edges for the backing tape which taper on both sides to the tip of the dispensing tongue. In this case, it is not necessary to change out or rotate the dispensing tongue upon changing the labeling direction.

The dispensing arm can have connection means on opposing longitudinal sides for the detachable connection of the dispensing arm to a press-on device for the pressing of labels to the containers. A provision can equally be made for the dispensing arm to have a press-on device on each side. It goes without saying that, in the case of press-on devices of the dispensing arm that are arranged to be mutually opposed, any modification of the dispensing device can be omitted during the changing of the labeling direction.

If the dispensing arm is joined to the conveying device such that it can rotate on its longitudinal axis, a press-on device which is joined to the longitudinal side of the dispensing arm can be positioned both against the one labeling device and against the other one by rotating the dispensing arm about its longitudinal axis. In this embodiment, it is thus sufficient that the dispensing arm have a press-on device on only one longitudinal side. The press-on device is then rotated together with the dispensing arm by approx. 180° about the longitudinal axis of the dispensing arm during a change of the labeling direction. This enables a simple and quick modification of the dispensing device in the event of a change of the labeling direction of the objects to be labeled.

The press-on device can be designed in a manner known per se, namely as a brush or a roller made of rubber or foam. A device can be preferably provided at the tip of the dispensing arm in order to apply the label onto an object by means of pressurized air, particularly [with] one or more suction stamps or one or more blow outlets.

In another embodiment of the invention, the dispensing arm can be connectable on opposing sides to the conveying device. In this case, the conveying device has connection means on opposing sides of an axis determined by the position of the roller units to connect the dispensing device to the conveying device. Presupposing a commensurate arrangement of the drive unit and its change in position, respectively, it is hence possible in a simple manner to modify the labeling device according to the invention for labeling of containers conveyed past the conveying device from different sides of the conveying device. This contributes to a greater flexibility in setting up the labeling device relative to the containers to be labeled.

Finally, a provision can be made that at least one printing device for the printing of the labels in the direction of conveyance of the backing tape is provided before the passing of the dispensing device and that the printing device is designed and arranged such that labels in different directions of conveyance of the conveyor belt can be printed equally. This ensures that a printing of the labels is guaranteed even in the event of a changing of the labeling direction of the objects to be labeled without modification of the labeling device.

In the following, the invention is explained by means of example on the basis of the drawing without being limited to the embodiment depicted in the drawing of a labeling device according to the invention.

Figure 2:
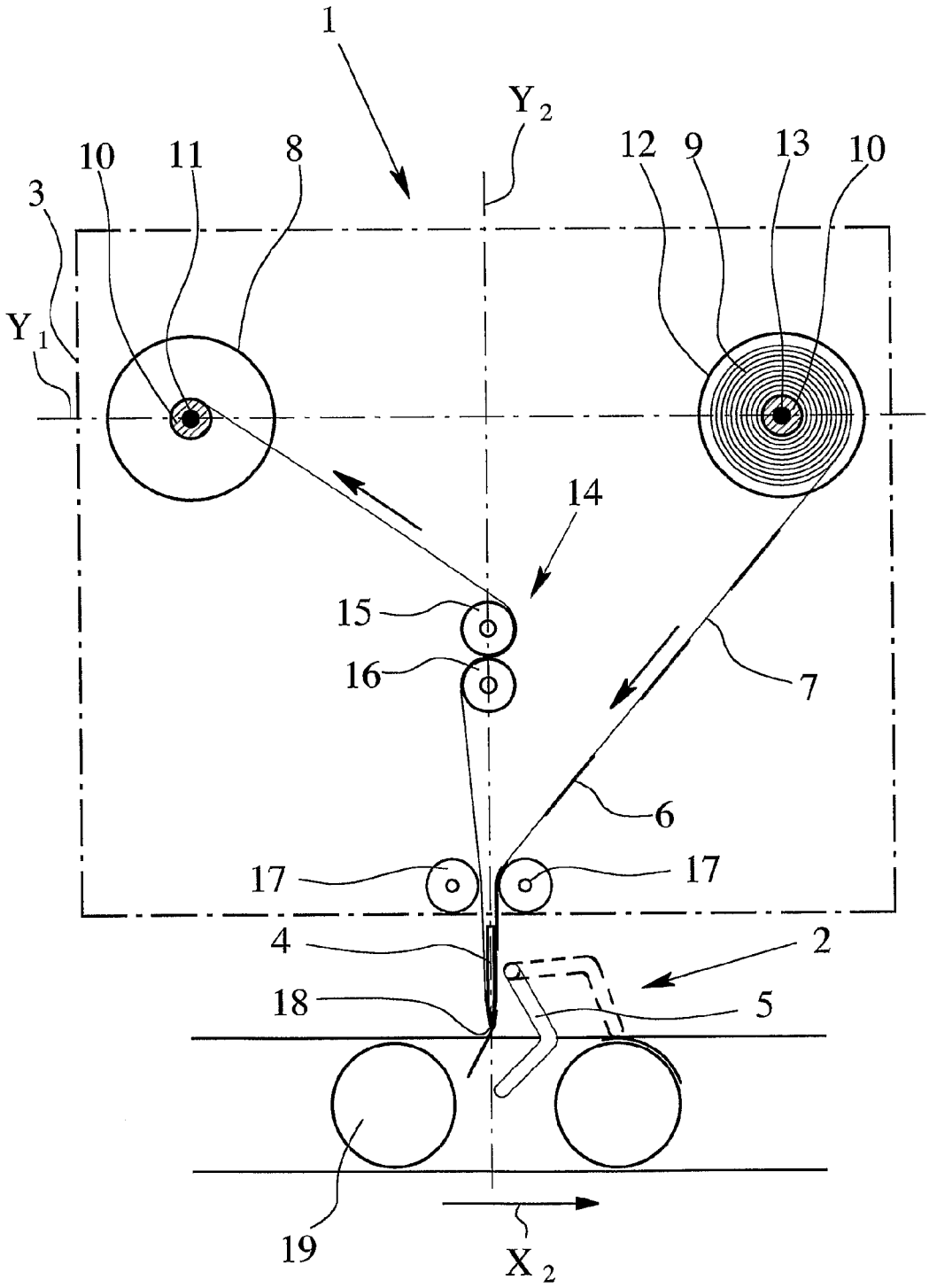

FIG. 1 shows a schematic representation of a labeling device according to the invention for the labeling of objects which are conveyed past the labeling device in counterclockwise rotation, and FIG. 2 shows a schematic representation of the embodiment depicted in FIG. 1 in an operational state of the labeling of objects which are conveyed past the labeling device in clockwise rotation.

Depicted in FIG. 1 is a schematic representation of a labeling device 1 according to the invention which has a dispensing device 2 and a conveying device 3. The dispensing device 2 has a dispensing arm 4 and a press-on device 5. The dispensing device 2 is designed to detach labels 6 from a backing tape 7 during the labeling of objects.

The conveying device 3 has a pivoted roller unit 8 for the storage of a label roll 9. The backing tape 7 can be reeled up on a backing tape roll 10 of the label roll 9 with labels 6 facing toward the outside. The same type of backing tape roll 10 can also be provided for the reeling up of the backing tape 7 after the detachment of the labels 6. In principle, it is also possible that an inwardly wound label roll 9 be used. The first roller unit 8 has a mounting segment 11 for the storage of the label roll 9, with the label roll able to be pushed up onto the mounting segment 11 and subsequently connected positively to the mounting segment 11 using appropriate means. A frictional connection is also possible. Per FIG. 1, the roller unit 8 is provided as a dispensing unit for the label roll 9.

Moreover, the conveying device 3 has a second pivoted roller unit 12 which has a mounting segment 13 onto which a backing tape roll 10 can be pushed up and subsequently secured against twisting. A frictional connection can be provided here as well. The roller units 8, 12 are designed identically including the mounting segments 11 and 13. Per FIG. 1, the roller unit 12 is provided as a reel-up unit for the reeling up of the backing tape 7 onto the backing tape roll after labeling.

In addition, the conveying device 3 has at least one drive unit 14 with a drive roller 15 and a counter-pressure roller 16. Though it is not shown in detail, the drive unit 14 can be coupled kinematically to the first roller unit 8 and the second roller unit 12 in order to ensure a continuous forward-driving movement of the backing tape 7 during the labeling and the reeling-up of the backing tape 7 onto the backing tape roll 10, respectively, in different labeling directions. The roller units can also optionally have their own drive. The conveying device 3 can have guide rollers 17 in order to properly guide and/or reroute the backing tape 7.

The roller units 8, 12 are arranged next to each other at the same level in the area of a horizontal axis $Y_1$ of the conveying device 3. The drive unit 14 and the dispensing device 2 are arranged on a vertical axis $Y_2$, resulting in a symmetrical construction of the conveying device 3. A provision is made that the first roller unit 8 and the second roller unit 12 are arranged mirror-symmetrically to the drive unit 14 and to the dispensing device 2. The roller units 8, 12 and the dispensing arm 4 are preferably arranged at the corner points of a triangle-shaped base surface. This leads to a substantially symmetrical arrangement of the roller units 8, 12, the drive unit 14, and the dispensing device 2. Consequently, a uniform load of the backing tape 7 can be ensured even when the labeling direction $X_1$, $X_2$ is changed.

The conveying device 3 is designed for conveying the backing tape 7 starting from the label roll 9 via the dispensing arm 4 to the backing tape roll 10. In so doing, the backing tape 7 is guided through the guide rollers 17 such that the backing tape 7 is redirected in the area of the tip 18 of a dispensing tongue of the dispensing arm 4, as a result of which the label 6 is detached from the backing tape 7 and applied by the press-on device 5 onto a container 19 to be labeled. The labeling process as such is performed in a manner known per se from the prior art.

After labeling, the backing tape 7 is guided over the drive unit 14 to the backing tape roll 10 and reeled up onto same. Here, the drive unit 14 is arranged in the direction of conveyance of the backing tape 7 behind the dispensing device 2, with a tensile force being exerted on the backing tape 7 as a result of the guiding of the backing tape 7 between the drive roller 15 and the counter-pressure roller 16. The drive device 14 is preferably coupled kinematically to both roller units 8, 12 so that the backing tape 7 is in all cases tightly reeled up on the driven backing tape roll 10. In order to control the labeling process and the backing tape conveyance automatically, a control device (not depicted) is provided.

Depicted in FIG. 1 is the labeling process for a first labeling direction $X_1$ of the containers 19, with the containers 19 passing by the dispensing arm 4 in a counter-clockwise direction. In order to enable labeling in different labeling directions $X_1$, $X_2$, a provision is now made that the second roller unit 12 is also designed for storing a label roll 9. Through the depicted arrangement of the roller units 8, 12 relative to the drive unit 14 and the dispensing device 2 as well as through a kinematic coupling of the roller units 8, 12 to the drive unit 14, it is possible with equivalent design of the roller units 8, 12 to provide the first roller unit 8 or the second roller unit 12 for storage of a label roll 9, with the respectively other roller unit 8, 12 being provided for the storage of an (empty) backing tape roll 10. As a result, to change the labeling direction $X_1$, $X_2$, it is necessary to switch out neither the roller units 8, 12 nor the drive roller 15 or the counter-pressure roller 16. The changing of the labeling direction $X_1$, $X_2$ is therefore possible without a modification of the conveying device 3. It is merely necessary to place the label roll 9 and the (empty) backing tape roll 10, which is provided for the reeling-up of the conveyor belt 7 after the detachment of the labels 6, as needed onto one or the other roller unit 8, 12 and to reverse the direction of conveyance of the drive roller 15.

Depicted schematically in FIG. 2 is the labeling process for the opposite labeling direction $X_2$, with the containers 19 being conveyed past the dispensing device 2 in a clockwise direction. In comparing FIGS. 1 and 2, it turns out that the dispensing arm has the same angle to the labeling direction $X_1$, $X_2$ in both labeling directions $X_1$, $X_2$. According to FIG. 2, the label roll 9 is mounted on the second roller unit 12, with the second roller unit 12 being provided as a dispensing unit. After passing through the dispensing device 2, the empty backing tape 7 is guided through the drive roller 15 and the counter-pressure roller 16 and reeled up onto the empty backing tape roll 10 which, according to FIG. 2, is now mounted on the first roller unit 8. In the labeling direction $X_2$ depicted in FIG. 2, the first roller unit 8 is hence provided as a reel-up unit.

In order to press the label 6 against the container 19 moving in the labeling direction $X_2$, a provision is preferably made upon reversal of the direction of conveyance of the backing tape 7 that the press-on device 5 is detached from the side of the dispensing arm 4 depicted in FIG. 1 and connected to the opposing side of the dispensing arm 4. This is shown in FIG. 2. For this purpose, the dispensing arm 4 has appropriately designed connection means on both dispensing sides. In principle, it is of course also possible that the dispensing arm 4 be connected to the conveying device 3 such that it can rotate about its longitudinal axis, so that it is possible to rotate the dispensing arm 3 upon changing the labeling direction $X_1$, $X_2$, with the press-on device 5 always effecting the pressing of the labels 6 onto the containers 19 during labeling.

The invention claimed is:

1. A labeling device with a conveying device having a drive unit for conveying a backing tape having a plurality of labels and a dispensing device for detaching the labels from the backing tape during the labeling of a plurality of containers to be labeled, wherein the backing tape having the labels is dispensed from a label roll and conveyed to the dispensing device and wherein, after detachment of the labels from the backing tape, the backing tape is rewound onto a backing tape roll, wherein the conveying device has roller units for supporting the label roll and the backing tape roll, wherein the roller units can each be driven in different directions of rotation and wherein the conveying direction of the backing tape can be clockwise or counterclockwise in order to label the containers in two different labeling directions through reversal of the rotation of the drive unit, wherein the roller units are designed equivalently and each roller unit has a mounting segment for mounting the label roll and the backing tape roll, wherein depending on the labeling direction of the containers to be labeled, the roller units can be connected to the label roll and the backing tape roll so that without modifying the roller units and depending on the labeling direction, the label roll is mounted for dispensing of the backing tape on one of the roller units and the backing tape roll is mounted respectively on the other roller unit.

2. The labeling device as set forth in claim 1, wherein the drive unit has a drive roller and a counter-pressure roller and that the arrangement of the drive roller and the counter-pressure roller is unchanged relative to the roller units in both labeling directions.

3. The labeling device as set forth in claim 1, wherein the roller units are kinematically coupled to the drive unit to produce a common rotational movement.

4. The labeling device as set forth in claim 1, wherein the roller units are arranged in one direction next to each other on a first axis and the drive unit and the dispensing device are arranged in one direction on a second axis, and that the first axis and the second axis are overlaid in the manner of a cross, resulting in a mirror-symmetrical arrangement of the roller units relative to the drive unit and the dispensing device.

5. The labeling device as set forth in claim 1, wherein the roller units and the dispensing device are arranged at the corner points of a substantially equal-sided triangle-shaped base surface of the conveying device, with the base of the triangle being determined by the position of the roller units and the tip of the triangle being determined by the position of the dispensing device.

6. The labeling device as set forth in claim 1, wherein the drive unit is arranged in the direction of conveyance of the backing tape behind the dispensing device.

7. The labeling device as set forth in claim 1, wherein the dispensing device has a dispensing arm and that the longitudinal axis of the dispensing arm is arranged substantially perpendicularly to the labeling direction in both labeling directions, with the dispensing arm being joined in a fixed manner to the conveying device.

8. The labeling device as set forth in claim 1, wherein a dispensing tongue is provided on the free end of the dispensing arm and that the dispensing tongue has beveled edges on both sides for the backing tape which taper on both sides to the tip of the dispensing tongue.

9. The labeling device as set forth in claim 1, wherein the dispensing arm has connection means on opposing longitudinal sides for the detachable connection of the dispensing arm to a press-on device for the pressing of the labels onto the containers or that a press-on device is provided on each side of the dispensing arm.

10. The labeling device as set forth in claim 1, wherein the dispensing arm is joined to the conveying device such that it can rotate on its longitudinal axis.

11. The labeling device as set forth in claim 1, wherein the dispensing arm can be joined to the conveying device on opposing sides of neighboring roller units.

12. The labeling device as set forth in claim 1, wherein at least one printing device for the printing of the labels is provided in the direction of conveyance of the backing tape before the dispensing device, and wherein the printing device has means for the printing of the labels in different directions of conveyance of the backing tape.

* * * * *